United States Patent [19]

Schnyder

[11] 3,971,607

[45] July 27, 1976

[54] FABRIC HAND TOWEL DISPENSER

[75] Inventor: Conrad W. Schnyder, Triesenberg, Liechtenstein

[73] Assignee: Neuco Apparatebau AG, Zug, Switzerland

[22] Filed: Oct. 24, 1974

[21] Appl. No.: 517,585

[30] Foreign Application Priority Data

Oct. 29, 1973 Switzerland ..... 15177/73

[52] U.S. Cl. ..... 312/38; 312/39

[51] Int. Cl.² ..... B65H 19/00

[58] Field of Search ..... 312/38, 39

[56] References Cited

UNITED STATES PATENTS

| | | | |
|---|---|---|---|
| 2,425,915 | 8/1947 | Birr | 312/38 |
| 3,215,481 | 11/1965 | Kobi | 312/38 |
| 3,222,112 | 12/1965 | Bahnsen | 312/38 |
| 3,323,848 | 6/1967 | Bahnsen | 312/38 |
| 3,826,548 | 7/1974 | Schnyder et al. | 312/38 |
| 3,858,951 | 1/1975 | Rasmussen | 312/38 |

*Primary Examiner*—Paul R. Gilliam
*Assistant Examiner*—Carl F. Pietruszka

[57] ABSTRACT

A fabric hand towel dispenser is disclosed which has an electric motor for winding up used hand towel, and a towel brake member for smoothing and tensioning the used hand towel which is being wound up. The towel brake member is a movably mounted flap, and biasing means are provided for urging this flap yieldingly into an operative position between two projections. In this way the towel brake flap can serve several additional purposes: It can actuate a switch for switching the electric motor off when the hand towel is tensioned and pushes the flap out between the projections against the effect of the biasing means. It can also actuate a switch for switching the electric motor off when the end of the hand towel has passed the flap so that the latter drops further between the projections; however, a separate detector finger, coaxial with the flap may also be used for this second purpose, if desired. The biased towel brake flap also serves to center the hand towel laterally if the space between the two projections is bounded in depth by a wall which is curved forwardly at the lateral ends of the brake flap. If it is desired to unwind used hand towel, the towel brake flap may be automatically retracted from between the two projections against the action of the biasing means, and held in an ineffective position during the unwinding.

6 Claims, 5 Drawing Figures

FABRIC HAND TOWEL DISPENSER

This invention relates to a fabric hand towel dispenser comprising a housing with means for holding a fresh hand towel reel and a used hand towel reel, an electric motor for driving the used hand towel reel to draw used hand towel into the housing, and a smoothing stripper member for deflecting and thereby tensioning and smoothing the hand towel passing to the used hand towel reel.

In fabric hand towel dispensers in which the used hand towel is wound up on a reel, it is usual to smooth out the hand towel which is passing to the used hand towel reel by means of a hand towel brake in the form of a smoothing stripper member, and to hold it lightly tensioned by this means so that it will be rolled up in proper fashion. In known hand towel dispensers the smoothing stripper member is for example in the form of a rib which co-operates with projections arranged on the rear wall of the housing. This rib is fixed during the operation and can only be moved away from the projections when it is required to "thread in" the starting end of a new hand towel.

It is also known to use an electric motor for driving the used hand towel reel in a fabric hand towel dispenser. During a single use of the hand towel a loop of this towel hangs for a predetermined period out from the dispenser. After expiry of this period the electric motor is automatically switched on to wind up the used length of hand towel of the loop and it is then switched off again as soon as the hand towel has been pulled taut over the bottom of the housing. A switch is, for example, arranged on the underside of the housing for this purpose and this is operated by the tautened hand towel.

It is now found that a simplification of this arrangement and also additional improvements and advantages can be achieved if the smoothing stripper member is movably mounted and pressed into an operative position by yieldable biasing means, and is used as the member for operating the switch.

The fabric hand towel dispenser of the aforementioned kind which has been devised in accordance with this invention is characterised by the fact that the smoothing stripper member is movably mounted, that biasing means engage the same so that it is urged yieldably into an operative position between two projections and that this member is so arranged as to be pushed out between the projections by the hand towel, when the tension in the latter exceeds a predetermined value, and thereby to operate a switch for switching off the electrical motor.

The smoothing stripper member not only operates the switch when the hand towel has been wound up until it is tautened over the bottom of the housing, but also when the tautening of a hand towel which is to be wound up becomes excessive for any other reason, for example because it is held somewhere. This will prevent over-loading of the motor.

If the parts of the rear wall of the housing beyond the lateral ends of the smoothing stripper member are protruded forward, the movability and pre-loading of the smoother stripper member can bring the result that the hand towel will seek to escape from the protruding sections of the wall and thus remain centrally between them.

The smoother stripper member can also be used to monitor the running of the end of the hand towel through the device and then operate the aforementioned switch, or a separate switch, to stop the electric motor. Instead of this, use could be made for this purpose of a separate detector member, for example combined with the smoother stripper member (and in particular mounted co-axially with the latter).

In the case of a hand towel dispenser in which not only does a fresh length of hand towel have to be dispensed for use, but at the same time used hand towel shall be delivered from the reel of used hand towel, or withdrawn therefrom, devices may be provided which hold the smoother stripper member, automatically and against the action of the biasing means, out of effective position during the dispensing of this used hand towel.

Preferred embodiments of the fabric hand towel dispenser according to the invention are illustrated in the accompanying drawings, in which.

Figure 1:
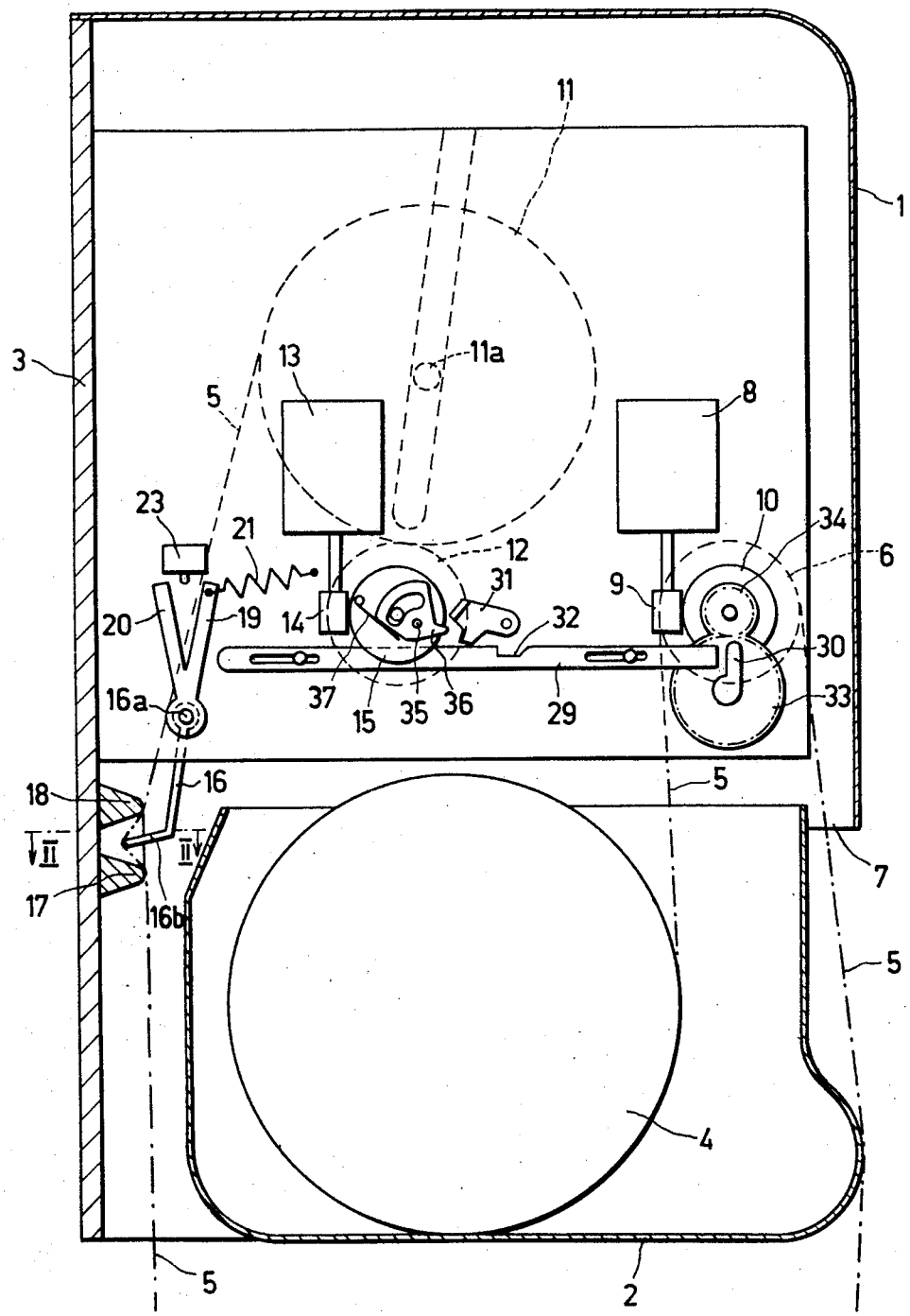
FIG. 1 is a diagrammatic side view of a hand towel dispenser with a side wall of the housing removed.

The fabric hand towel dispenser illustrated in FIG. 1 comprises a housing with an upper part 1, a lower part 2 and a rear wall 3 which is to be fastened to a fixed wall, for example that of a toilet. The lower part 2 is of cupped form and is used to receive and hold a reel 4 of fresh hand towel.

The hand towel 5, which is illustrated in chain dotted lines, runs from the reel 4 over a supply roller 6 and passes out of the housing through a slot 7. The roller 6 can be driven by an electric motor 8 through a worm 9 and a worm wheel 10 for the purpose of delivering the hand towel.

The used towel can be wound up on a reel 11 on a spindle 11*a* which is freely mounted and guided in a slot. The reel 11 rests on a draw-in roller 12. This roller 12 is driven by an electric motor 13 which is connected to the spindle of the draw-in roller through a worm 14 and a worm wheel 15.

The hand towel passing to the reel 11 of used hand towel is smoothed and tautened through the agency of a hand towel brake comprising a flap 16 which is pivotable on a spindle 16*a*. Flap 16 has a limb 16*b* which projects, when in the working position illustrated, into the space between two rib-like projections 17 and 18 secured to the rear wall 3, and thereby diverts the hand towel. Even a maximum frictional force of the towel passing to the reel 11 cannot turn the flap 16 clockwise further than to the point where the plane of the towel section between the end of the flap and the projection 18 passes through the spindle 16*a*.

Attached to the spindle 16*a* of flap 16 are two switching arms 19 and 20, one of which has a tension spring 21 attached thereto. This spring 21 represents a resilient biasing means which holds the flap 16 yieldingly in its operative position and against the hand towel 5. Other biasing means can of course be used instead of a spring, for example a gravity loaded device or a magnetically-operated presser means.

Figure 2:
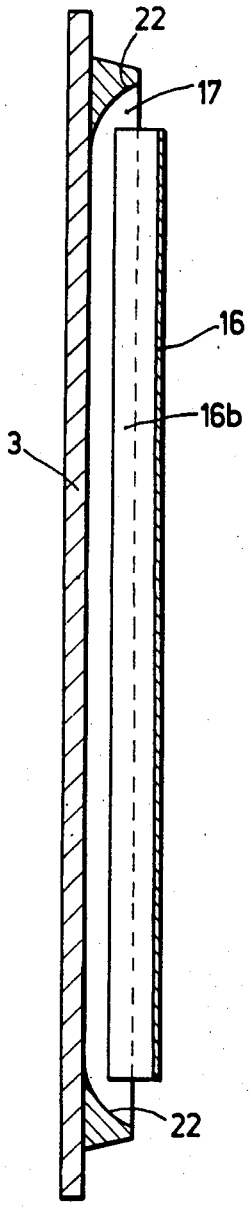
FIG. 2 is a section on the line II — II of FIG. 1.

As can be seen from FIG. 2, the wall which defines at the rear the space between projections 17 and 18, that is to say the depth of this space, is extended forward at each end of the flap 16 by a rounded part 22. As a consequence of the pressure of the flap 16 against the hand towel the latter is biased away from these rounded ends 22 so that it slips or remains centrally between them.

The two switching arms 19 and 20 co-operate with an electrical switch 23 which can be operated to interrupt the supply of current to the electric motor 13. When the pull on the towel running to the reel 11 is excessive, for example when a user keeps hold of the towel or when, after use, the complete loop of hand towel is wound up again and the towel is tightened up over the lower part of the housing, the towel presses the flap 16 against the action of spring 21 out of the space between projections 17 and 18. As a result the arms 19 and 20 are turned in the counterclockwise direction (as seen in FIG. 1), and the arm 19 operates switch 23 to switch the motor 13 off.

When the full supply of hand towel from reel 4 is used up and the end of the hand towel has run past flap 16 it obviously no longer acts on this flap and the latter drops, under impulsion of spring 21, completely into the space between the projections. As a result the switching arm 20 moves in the clockwise direction to operate switch 23 and stop the draw-in motor 13. The switching arm 20 can of course alternatively be arranged on the spindle 16*a* in such a way that after the end of the hand towel has passed it does not operate switch 23 but a separate switch (not shown) for cutting out motor 13.

Figure 3:
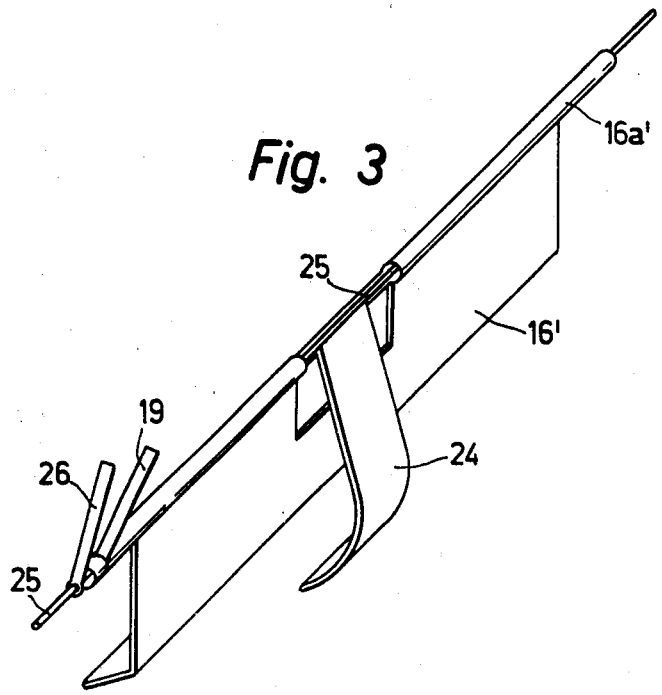
FIG. 3 is a diagrammatic illustration of a smoothing stripper flap used in a modified embodiment of the hand towel dispenser.
Figure 4:
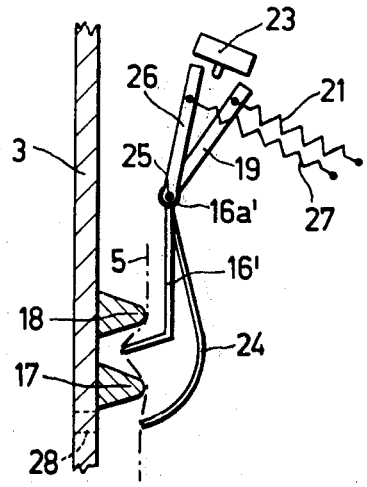
FIG. 4 is an end view corresponding to FIG. 3.

In many instances it may be desirable, for more positively checking the passage of the end of the hand towel, to use a separate detector member which is operable by the hand towel independently of the smoothing stripper flap. An arrangement of this character is diagrammatically illustrated in FIGS. 3 and 4. These show a smoothing stripper flap 16' which is pivotally mounted by means of a hollow shaft 16*a'*. This shaft 16*a'* carries the switching arm 19 which co-operates with switch 23 and has the tension spring 21 attached thereto. Flap 16' co-operates with the projections 17 and 18, as does the flap 16 in FIG. 1, to smooth out the hand towel and to cut out the motor 13 through switch 23 when the towel is fully tautened.

The passage of the end of the hand towel is monitored by a separate detector member. This has the form of a pivotable detector finger 24 the pivot axis 25 of which is arranged inside the hollow shaft 16*a'* coaxially with the latter and is rotatable independently thereof.

This pin 25 has a switching arm 26 engaged by a tension spring 27 which holds the free lower end of the detector finger 24 against the hand towel 5. When the end of the hand towel has passed the finger 24 this is turned in the clockwise direction by spring 27 and its other end can drop into a hole 28 in the rear wall 3. As a result the switching arm 26 operates the switch 23, or a separate switch (not shown), to cut out the draw-in motor 13.

As illustrated, the detector finger 24 extends from its pin 25 through a cut-out in the hollow shaft 16*a* and in the flap 16'. When the flap 16' is swung away from the projections 17 and 18 for the "threading in" of the start of a new hand towel the detector finger 24 is thereby automatically moved out of the way so that it does not obstruct this threading in process.

In the case of hand towel dispensers of the kind described, in which the hand towel is drawn taut over the lower part of the housing when it strands ready for use, and fresh towel is to be dispensed over the supply roller 6 before use, it is desirable that a length of used hand towel from reel 11 shall be wound off simultaneously with the dispensing of a fresh length of hand towel. The user of course only employs the front part of the loop of towel which has been dispensed. For this reason draw-in motor 13 can be caused, with the aid of suitable control means, to run backwards. However, with the flap 16 or 16' in the operative position, the friction on this flap and on projections 17 and 18 might prevent the used towel unwound from reel 11 from flowing freely downwards and out of the housing. For this reason, use is made of an arrangement which automatically withdraws the flap from the space between the projections 17 and 18 as soon as hand towelling is issued by the roller 6 and at the same time by the draw-in roller 12. This arrangement (see FIG. 1) comprises a shiftable bar 29 the left hand end of which abuts against the arm 19 to draw back the flap 16 from the space between the projections 17 and 18 when this bar is shifted to the left by a dog 30. A pawl 31 then drops into a notch 32 in the upper side of bar 29 to hold this in its effective position with the flap withdrawn. Dog 30 is mounted on a toothed wheel 33 which meshes with a pinion 34 on the shaft of the dispenser roller 6. Thus the cam 30 is moved from the rest position (as illustrated) to the left as soon as the roller 6 turns in the dispensing direction (i.e. the clockwise direction in FIG. 1). The issue of hand towel is stopped after one rotation of wheel 33 by control means which are not here described or illustrated. Worm wheel 15 carries a pawl 36 which is pivoted about an eccentric axis 35 and is urged by a leaf spring 37 into the operative position illustrated in which it co-operates with a projection on pawl 31. During dispensing of hand towel from reel 11, when the worm wheel 15 turns in the clockwise direction, the pawl 36 can be pivoted from its operative position against the action of spring 37 so that it can pass the pawl 31. During this the pawl 31 remains engaged in notch 32. When, however, used hand towel is wound up after use, with the worm wheel 15 turning in the counter-clockwise direction, the pawl 36 engages the projection on pawl 31 and it cannot be deflected because the end of a slot therein abuts against the spindle of worm wheel 15. As a consequence pawl 31 is now lifted out of notch 32 so that the spring 21 will turn the flap 16 back to the operative position illustrated, as a result of which the bar 29 is shifted back to the right.

As will now be explained briefly in reference to an example given in FIG. 5, a movable, prebiased smoothing stripper flap, and a device for automatically retracting the same for the supply of used hand towelling may also of course be provided in a hand towel dispenser which only comprises an electric motor for the winding up of the hand towel after use whilst the actual delivery of the towel can be effected by manually pulling it.

Figure 5:
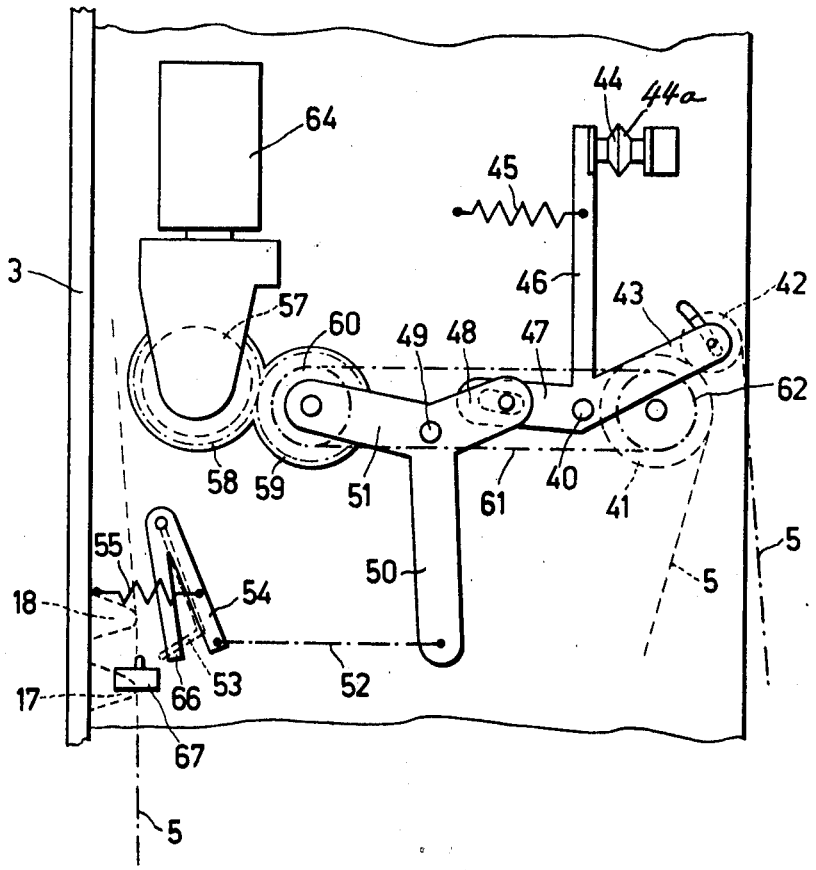
FIG. 5 shows part of a hand towel dispenser of another form, this view being similar to that of FIG. 1.

In FIG. 5 a presser roller 42 bears against a dispensing roller 41 around which the hand towel 5 is guided. The presser roller 42 is carried by a lever arm 43 pivotable about a spindle 40. When the user pulls on the hand towel 5, issuing from the housing (which is not illustrated here but is of a form similar to that shown in FIG. 1), the lever arm 43 with the roller 42 is first pivoted into the position illustrated, against the action of a tension spring 45. This tension spring 45 engages an arm 46 which is connected to the arm 43 and also carries a suction cup 44 which holds the arm 46 in the illustrated position in engagement with a counter element in the form of a second suction cup 44*a*, during a predetermined period of use of the hand towel.

A further arm 47 integrally connected to the arm 43 is coupled with an arm 48 of another lever through a pin and slot connection, and this arm 48 is pivoted about a spindle 49. When the lever arm 43, 46, 47 is pivoted as previously described, the other lever, which has two arms 50 and 51 in addition to arm 48, is pivoted in the counterclockwise direction into the position illustrated. In this motion a draw member 52 which is secured to the arm 50 draws a switching arm 54 connected to a smoothing stripper flap 53 to the left against the action of a tension spring 55, as a result of which the flap 53 is withdrawn from the space between the projections 17 and 18.

The manual turning of the dispensing roller 41, effected by pulling on the hand towel, is also transmitted to a draw-in roller 57 so that this will turn the roller of used hand towel (not shown) in the unwinding direction. For this purpose the draw-in roller 51 has a toothed wheel 58 which meshes with a toothed wheel 59 carried by lever arm 51, when this lever arm is in the position illustrated. Connected to the toothed wheel 59 is a chain wheel 60 which is coupled by a chain 61 with a chain wheel 62 on the shaft of the dispensing roller 41. Thus when roller 41 is turned in the counter-clockwise direction by drawing off hand towel, the draw-in roller 57 turns in the clockwise direction and winds the hand towel away from the reel of used hand towel.

After the expiry of the predetermined period of use the suction cup 44 carried by the lever arm 46 releases and the lever arm is turned in the counter-clockwise direction by spring 45. This pivots the lever 48, 50, 51 in the clockwise direction, and arm 51 disengages toothed wheel 59 from toothed wheel 58. At the same time the arm 50 no longer holds the draw member 52 tensioned, so that spring 55 draws the smoothing stripper flap 53 into its effective position between the projections 17 and 18 (similar to that illustrated for flap 16 in FIG. 1). An electric motor 64 which is connected to the draw-in roller 57 through a planetary gearing is now brought into action, for example by a switch (not shown) operated by the lever arm 46, so as to turn the draw-in roller in the counter-clockwise direction and thereby cause the winding up of the used hand towel. As soon as the hand towel tightens up, it presses the stripper flap 53 out between the projections 17 and 18, and a switch arm 66 connected to the flap operates a switch 67 to cut out the electric motor 64.

The switch 67 may also be operated by arm 54, when all the hand towel has passed through and the flap 53 penetrates a maximum between the projections 17 and 18, that is to say up against the rear wall 3.

What we claim is:

1. A fabric hand towel dispenser comprising a housing; means mounted in said housing for holding a fresh hand towel reel and a used hand towel reel; an electric motor in said housing; means for coupling said motor to said used hand towel reel so that said motor is operable to drive the used hand towel reel for drawing used hand towel into said housing and winding it up on said used hand towel reel; a device for deflecting and thereby tensioning and smoothing the hand towel passing to the used hand towel reel, said deflecting device including two elongated straight projections mounted in said housing adjacent one side to the path of the hand towel passing to the used hand towel reel and extending transversely across this hand towel, a smoothing stripper flap pivotally mounted in said housing adjacent the opposite side of the path of the hand towel passing to the used hand towel reel, and biasing means engaging said smoothing stripper flap for urging it yieldably into an operative position in which an edge of said flap extends between said two projections, whereby said flap is pushed out between said projections by the hand towel when the tension in the latter exceeds a predetermined value; means coupled to said flap and arranged for operating a switch in an electric circuit to said motor for switching off said motor when said flap is pushed out between said projections; and a separate detector member including a detector finger mounted for pivoting about the same axis as said flap and adapted to bear against the hand towel passing to the used hand towel reel, said separate detector member further including means arranged for operating a switch for shutting off said electric motor when the end of the hand towel has passed said detector finger.

2. A fabric hand towel dispenser according to claim 1, comprising a pin pivotally supporting said detector finger in said housing, and a hollow shaft surrounding said pin and on which said flap is mounted.

3. A fabric hand towel dispenser comprising a housing: means mounted in said housing for holding a fresh hand towel reel and a used hand towel reel; an electric motor in said housing; means for coupling said motor to said used hand towel reel so that said motor is operable to drive the used hand towel reel for drawing used hand towel into said housing and winding it up on said used hand towel reel; a device for deflecting and thereby tensioning and smoothing the hand towel passing to the used hand towel reel, said deflecting device including two elongated straight projections mounted in said housing adjacent one side of the path of the hand towel passing to the used hand towel reel and extending transversely across this hand towel, a smoothing stripper member movably mounted in said housing adjacent the opposite side of the path of the hand towel passing to the used hand towel reel, and biasing means engaging said smoothing stripper member for urging it yieldably into an operative position in which an edge of said smoothing stripper member extends between said two projections, whereby said member is pushed out between said projections by the hand towel when the tension in the latter exceeds a predetermined value; means coupled to said smoothing stripper member and arranged for operating a switch in an electric circuit to said motor for switching off said motor when said member is pushed out between said projections; and devices for retracting said smoothing stripper member against the action of said biasing means and for holding said member in a retracted position during the dispensing of hand towel, said retracting device including a displaceable bar arranged for acting on said smoothing stripper member mechanically, and a dog coupled to a dispensing roller over which the hand towel to be dispensed is guided from the reel of fresh hand towel, said dog being arranged for pushing against said bar to displace it when said dispensing roller is turned, and said device for holding said smoothing stripper member in its retracted position including a pawl which is adapted to be brought out of effective engagement with said bar by an element which is coupled to said electric motor.

4. A fabric hand towel dispenser comprising a housing; means mounted in said housing for holding a fresh hand towel reel and a used hand towel reel; an electric motor in said housing; means for coupling said motor to said used hand towel reel so that said motor is operable to drive the used hand towel reel for drawing used hand towel into said housing and winding it up on said used hand towel reel; a device for deflecting and thereby tensioning and smoothing the hand towel passing to the used hand towel reel, said deflecting device including two elongated straight projections mounted in said housing adjacent one side of the path of the hand towel passing to the used hand towel reel and extending transversely across this hand towel, a smoothing stripper member movably mounted in said housing adjacent the opposite side of the path of the hand towel passing to the used hand towel reel, and biasing means engaging said smoothing stripper member for urging it yieldably into an operative position in which an edge of said smoothing stripper member extends between said two projections, whereby said member is pushed out between said projections by the hand towel when the tension in the latter exceeds a predetermined value; means coupled to said smoothing stripper member and arranged for operating a switch in an electric circuit to said motor for switching off said motor when said member is pushed out between said projections; and devices for retracting said smoothing stripper member against the action of said biasing means and for holding said member in a retracted position during the dispensing of hand towel, said retracting devices including a lever which is adapted to be pivoted when a pull is exerted on the hand towel passing from the fresh hand towel reel out of the housing, said lever being coupled to said smoothing stripper member through a mechanical connection which includes a draw member which is tensioned and retracts said smoothing stripper member when said lever is pivoted by pull on the hand towel, and said device for holding said smoothing stripper member in its retracted position including a suction cup which is secured to said lever and which is adapted to cooperate with a counter element when said lever is pivoted.

5. A fabric hand towel dispenser comprising a housing; means mounted in said housing for holding a fresh hand towel reel and a used hand towel reel; an electric motor in said housing; means for coupling said motor to said used hand towel reel so that said motor is operable to drive the used hand towel reel for drawing used hand towel into said housing and winding it up on said used hand towel reel; a device for deflecting and thereby tensioning and smoothing the hand towel passing to the used hand towel reel, said deflecting device including two elongated straight projections mounted in said housing adjacent one side of the path of the hand towel passing to the used hand towel reel and extending transversely across this hand towel, a smoothing stripper flap pivotally mounted in said housing adjacent the opposite side of the path of the hand towel passing to the used hand towel reel, and biasing means engaging said smoothing stripper flap for urging it yieldably into an operative position in which an edge of said flap extends between said two projections, whereby said flap is pushed out between said projections by the hand towel when the tension in the latter exceeds a predetermined value, and is pushed in between the projections beyond said operative position by said biasing means when the end of the hand towel has passed said edge of the flap; and means coupled to said flap and arranged for operating a switch in an electric circuit to said motor for switching off said motor when said flap is pushed out between said projections and when it is pushed in between the projections beyond said operative position.

6. A fabric hand towel dispenser comprising a housing; means mounted in said housing for holding a fresh hand towel reel and a used hand towel reel; an electric motor in said housing; means for coupling said motor to said used hand towel reel so that said motor is operable to drive the used hand towel reel for drawing used hand towel into said housing and winding it up on said used hand towel reel; a device for deflecting and thereby tensioning and smoothing the hand towel passing to the used hand towel reel, said deflecting device including two elongated straight projections mounted in said housing adjacent one side of the path of the hand towel passing to the used hand towel reel and extending transversely across this hand towel, a smoothing stripper flap pivotally mounted in said housing adjacent the opposite side of the path of the hand towel passing to the used hand towel reel, and biasing means engaging said smoothing stripper flap for urging it yieldably into an operative position in which an edge of said flap extends between said two projections, whereby said flap is pushed out between said projections by the hand towel when the tension in the latter exceeds a predetermined value; and means coupled to said flap and arranged for operating a switch in an electric circuit to said motor for switching off said motor when said flap is pushed out between said projections; the space between said two projections being bounded in depth by a wall having portions which extend toward the top of the projections outside of and adjacent to both lateral ends of said edge of said flap so that the towel, pushed into said space by said biased flap, is urged away from said wall portions toward the center.

* * * * *